US008068087B2

(12) United States Patent
Feng

(10) Patent No.: US 8,068,087 B2
(45) Date of Patent: Nov. 29, 2011

(54) METHODS AND SYSTEMS FOR REDUCED FLICKERING AND BLUR

(75) Inventor: Xiao-Fan Feng, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 762 days.

(21) Appl. No.: 12/129,513

(22) Filed: May 29, 2008

(65) Prior Publication Data

US 2009/0295706 A1 Dec. 3, 2009

(51) Int. Cl.
*G09G 3/36* (2006.01)
*G09G 5/10* (2006.01)

(52) U.S. Cl. ..... 345/102; 345/691

(58) Field of Classification Search ..... 345/102, 345/691

See application file for complete search history.

(56) References Cited

U.S. PATENT DOCUMENTS

| | | | | |
|---|---|---|---|---|
| 5,471,225 | A | 11/1995 | Parks | |
| 5,844,540 | A * | 12/1998 | Terasaki | 345/102 |
| 5,870,075 | A * | 2/1999 | Yamazaki et al. | 345/92 |
| 6,504,959 | B1 * | 1/2003 | Lee | 382/260 |
| 6,980,225 | B2 * | 12/2005 | Funamoto et al. | 345/691 |
| 7,109,963 | B2 | 9/2006 | Johnson | |
| 2001/0024199 | A1 | 9/2001 | Hughes | |
| 2002/0003522 | A1 * | 1/2002 | Baba et al. | 345/89 |
| 2002/0149574 | A1 | 10/2002 | Johnson | |
| 2002/0154088 | A1 | 10/2002 | Nishimura | |
| 2002/0175907 | A1 | 11/2002 | Sekiya | |
| 2003/0142118 | A1 * | 7/2003 | Funamoto et al. | 345/691 |
| 2003/0169247 | A1 | 9/2003 | Kawabe et al. | |
| 2004/0012551 | A1 | 1/2004 | Ishii | |
| 2004/0056825 | A1 * | 3/2004 | Min et al. | 345/38 |
| 2005/0184952 | A1 * | 8/2005 | Konno et al. | 345/102 |
| 2005/0248520 | A1 | 11/2005 | Feng et al. | |
| 2005/0248524 | A1 | 11/2005 | Feng et al. | |
| 2005/0248553 | A1 | 11/2005 | Feng et al. | |
| 2005/0248554 | A1 | 11/2005 | Feng et al. | |
| 2005/0248555 | A1 | 11/2005 | Feng et al. | |
| 2005/0248591 | A1 | 11/2005 | Feng et al. | |
| 2005/0248592 | A1 | 11/2005 | Feng et al. | |
| 2005/0248593 | A1 | 11/2005 | Feng et al. | |
| 2006/0181503 | A1 | 8/2006 | Feng | |
| 2006/0202945 | A1 * | 9/2006 | Feng | 345/102 |
| 2007/0285382 | A1 | 12/2007 | Feng | |
| 2008/0018571 | A1 | 1/2008 | Feng | |
| 2008/0198127 | A1 | 8/2008 | Decraemer | |

FOREIGN PATENT DOCUMENTS

| | | |
|---|---|---|
| EP | 1826745 | 8/2007 |
| JP | 01010299 | 1/1989 |

(Continued)

OTHER PUBLICATIONS

International Search Report for PCT/JP2009/059926 dated Sep. 25, 2009 claiming priority to the present application.

International Application No. PCT/JP2009059926—European Search Report dated Jun. 16, 2011.

*Primary Examiner* — Bipin Shalwala
*Assistant Examiner* — Hang Lin
(74) *Attorney, Agent, or Firm* — Krieger Intellectual Property, Inc.; Scott C. Krieger

(57) ABSTRACT

Aspects of the present invention relate to systems and methods for detecting motion in frames of a video sequence and for generating and applying a backlight modulation screen comprising at least one modulation pulse width dependent on the motion detection. Some aspects relate to a motion map variable used to determine modulation pulse widths for the backlight modulation screen.

13 Claims, 8 Drawing Sheets

FOREIGN PATENT DOCUMENTS

| | | |
|---|---|---|
| JP | 2001-154531 | 6/2002 |
| WO | WO02067238 | 8/2002 |
| WO | WO2004013835 | 2/2004 |
| WO | WO 2006072537 A1 | 7/2006 |

* cited by examiner

METHODS AND SYSTEMS FOR REDUCED FLICKERING AND BLUR

FIELD OF THE INVENTION

Embodiments of the present invention comprise methods and systems for generating, modifying and applying backlight driving values for an LED backlight array.

BACKGROUND

Some displays, such as LCD displays, have backlight arrays with individual elements that can be individually addressed and modulated. The displayed image characteristics can be improved by systematically addressing backlight array elements.

SUMMARY

Some embodiments of the present invention comprise methods and systems for generating, modifying and applying backlight driving values for an LED backlight array.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF EXEMPLARY EMBODIMENTS

Figure 1:
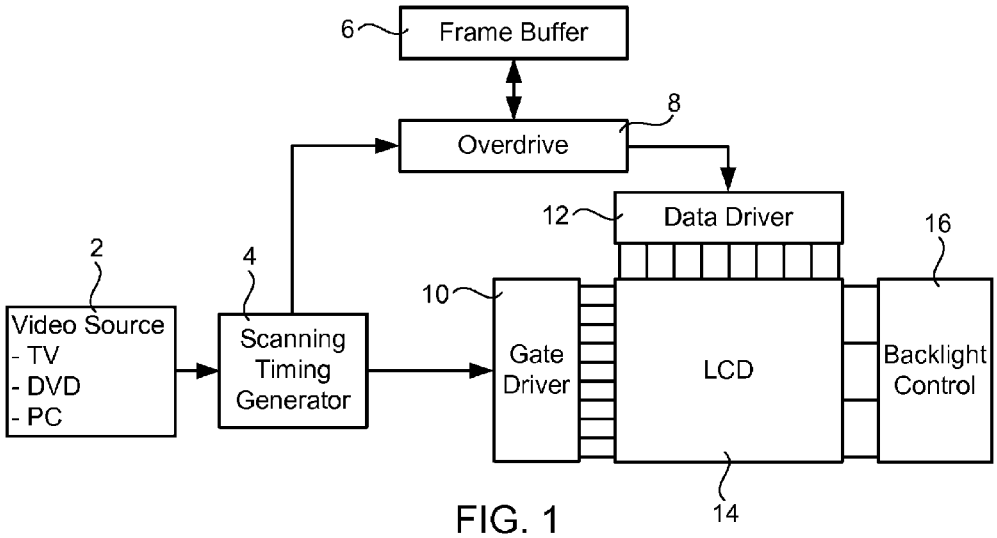
FIG. 1 is a diagram showing the elements of an exemplary LCD display.

Embodiments of the present invention will be best understood by reference to the drawings, wherein like parts are designated by like numerals throughout. The figures listed above are expressly incorporated as part of this detailed description.

It will be readily understood that the components of the present invention, as generally described and illustrated in the figures herein, could be arranged and designed in a wide variety of different configurations. Thus, the following more detailed description of the embodiments of the methods and systems of the present invention is not intended to limit the scope of the invention but it is merely representative of the presently preferred embodiments of the invention.

Elements of embodiments of the present invention may be embodied in hardware, firmware and/or software. While exemplary embodiments revealed herein may only describe one of these forms, it is to be understood that one skilled in the art would be able to effectuate these elements in any of these forms while resting within the scope of the present invention.

In a high dynamic range (HDR) display, comprising an LCD using an LED backlight, an algorithm may be used to convert the input image into a low resolution LED image, for modulating the backlight LED, and a high resolution LCD image. To achieve high contrast and save power, the backlight should contain as much contrast as possible. The higher contrast backlight image combined with the high resolution LCD image can produce much higher dynamic range image than a display using prior art methods. However, one issue with a high contrast backlight is motion-induced flickering. As a moving object crosses the LED boundaries, there is an abrupt change in the backlight: In this process, some LEDs reduce their light output and some increase their output; which causes the corresponding LCD to change rapidly to compensate for this abrupt change in the backlight. Due to the timing difference between the LED driving and LCD driving, or an error in compensation, fluctuation in the display output may occur causing noticeable flickering along the moving objects. The current solution is to use infinite impulse response (IIR) filtering to smooth the temporal transition, however, this is not accurate and also may cause highlight clipping.

An LCD has limited dynamic range due the extinction ratio of polarizers and imperfections in the LC material. In order to display high-dynamic-range images, a low resolution LED backlight system may be used to modulate the light that feeds into the LCD. By the combination of modulated LED backlight and LCD, a very high dynamic range (HDR) display can be achieved. For cost reasons, the LED typically has a much lower spatial resolution than the LCD. Due to the lower resolution LED, the HDR display, based on this technology, can not display high dynamic pattern of high spatial resolution. But, it can display an image with both very bright areas (>2000 cd/m$^2$) and very dark areas (<0.5 cd/m$^2$) simultaneously. Because the human eye has limited dynamic range in a local area, this is not a significant problem in normal use. And, with visual masking, the eye can hardly perceive the limited dynamic range of high spatial frequency content.

Another problem with modulated-LED-backlight LCDs is flickering along the motion trajectory, i.e. the fluctuation of display output. This can be due to the mismatch in LCD and LED temporal response as well as errors in the LED point spread function (PSF). Some embodiments may comprise temporal low-pass filtering to reduce the flickering artifact.

Aspects of some embodiments of the present invention may be described with reference to FIG. 1, which shows a block diagram of a data path in an LCD panel. Video data 2 from different sources are input to the scanning timing generator circuit 4 where video data is converted to a format that can be displayed on an LCD 14. Each line is sent to the overdrive circuit 8 to compensate for the LCD's slow temporal response. The overdriven signal is converted to a voltage in the data driver 12 and output to data electrodes on the LCD 14. The scanning timing generator 4 also outputs a clock to the gate driver 10, selects one row at a time, and stores the voltage data on the data electrode on the storage capacitor of each pixel. Scanning timing generator 4 also generates backlight control signal controlling timing for backlight flashes and sends these signals to the backlight controller 16. The overdrive circuit 8 may also store video image data in a frame buffer 6 to detect various changes or trends between video frames.

Motion Blur Reduction with Flashing Backlight

Typical overdrive processes can reduce the motion blur due to an LCD's slow temporal response, but generally do not eliminate the motion blur completely. This is due to the fact that the image displayed on the LCD is always on during the entire frame time. The fact that the eye tracks the motion while the image is held during the frame time causes a relative motion on the retina. The average effect of this relative motion on the retina is perceived as motion blur.

Figure 2:
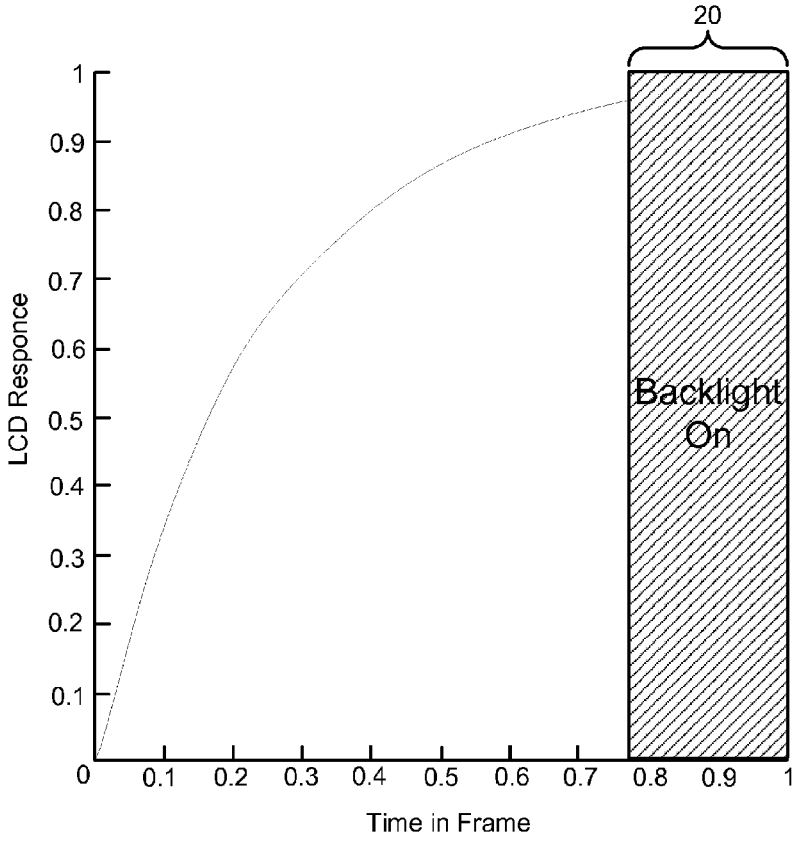
FIG. 2 is a chart showing a typical LCD response.

One way to reduce this motion blur is to reduce the time that an image frame is displayed. FIG. 2 illustrates a flashing backlight approach. The backlight is off after LCD driving voltage is applied and then turned on near the end of the frame period 20 when the LCD transmission approaches the target level.

Figure 3:
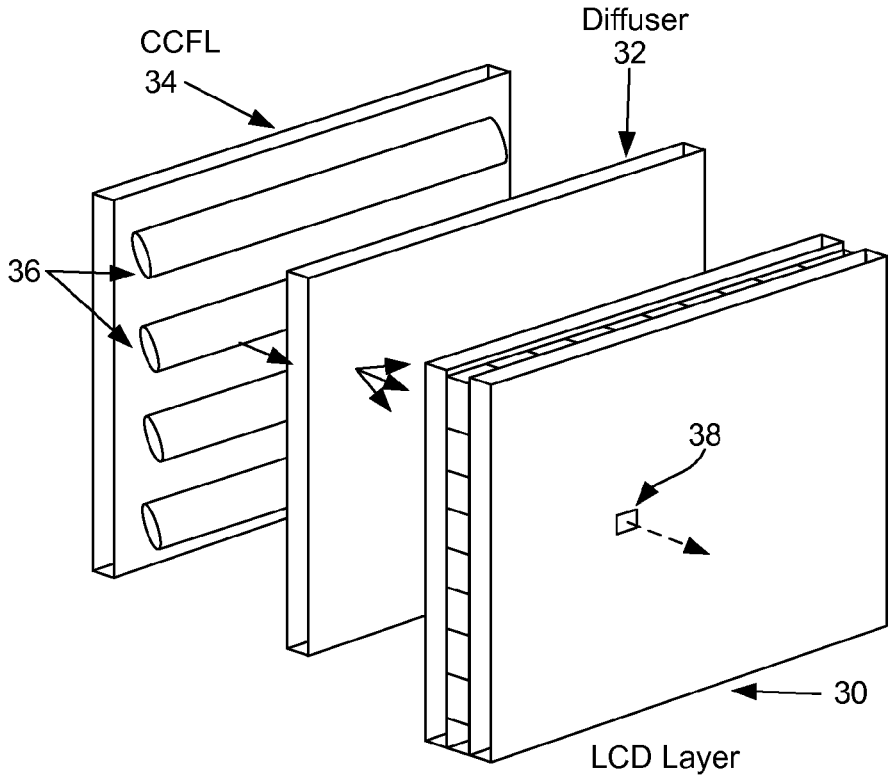
FIG. 3 is a diagram showing a typical LCD with a CCFL backlight.

FIG. 3 illustrates an LCD display comprising an LCD layer 30, which comprises a plurality of addressable LCD "cells" 38, which act as light valves that can be individually modulated. This display also comprises a diffusion layer or diffuser 32, which acts to diffuse light emitted from a backlight 34. The backlight 34 of this exemplary display comprises multiple cold-cathode fluorescent (CCFL) tubes 36. The diffusion layer 32 functions, at least in part, to diffuse the light from the tubes 36 so that the light is transmitted evenly onto the LCD layer 30. In some embodiments of the present invention, the backlight 34 can be modulated, such as by flashing, to effect motion-blur-related and flicker-related characteristics as well as brightness and other characteristics.

Figure 4:
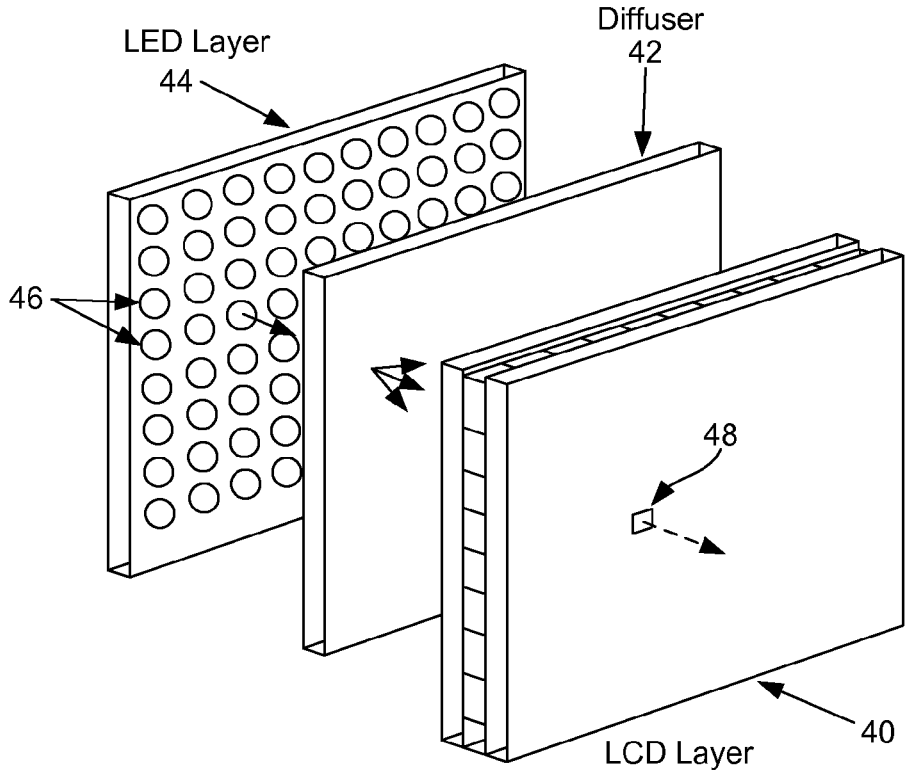
FIG. 4 is a diagram showing a typical LCD with an LED backlight.

FIG. 4 illustrates an LCD display comprising an LCD layer 40, which comprises a plurality of addressable LCD "cells" 48, which act as light valves that can be individually modulated. This display also comprises a diffusion layer or diffuser 42, which acts to diffuse light emitted from a backlight 44. The backlight 44 of this exemplary display comprises multiple light-emitting diode (LED) elements 46. The diffusion layer 42 functions, at least in part, to diffuse the light from the LEDs 46 so that the light is transmitted evenly onto the LCD layer 40. In some embodiments of the present invention, the backlight 44 can be modulated, such as by flashing, to affect motion-blur-related and flicker-related characteristics as well as brightness and other characteristics.

Backlight flashing can reduce motion blur, but, flickering, which is normally associated with a cathode ray tube (CRT) display, is visible due to the impulse backlight. One way to reduce the flickering artifacts is to increase the refresh rate. CRT monitors used in computer display are commonly set to a refresh rate of 75 Hz to reduce flickering. For an LCD, with a fixed frame rate, it is possible to flash the backlight multiple times per frame to increase the refresh rate. However, for motion images, multiple flashes in a single frame can cause ghosting images.

Figure 5:
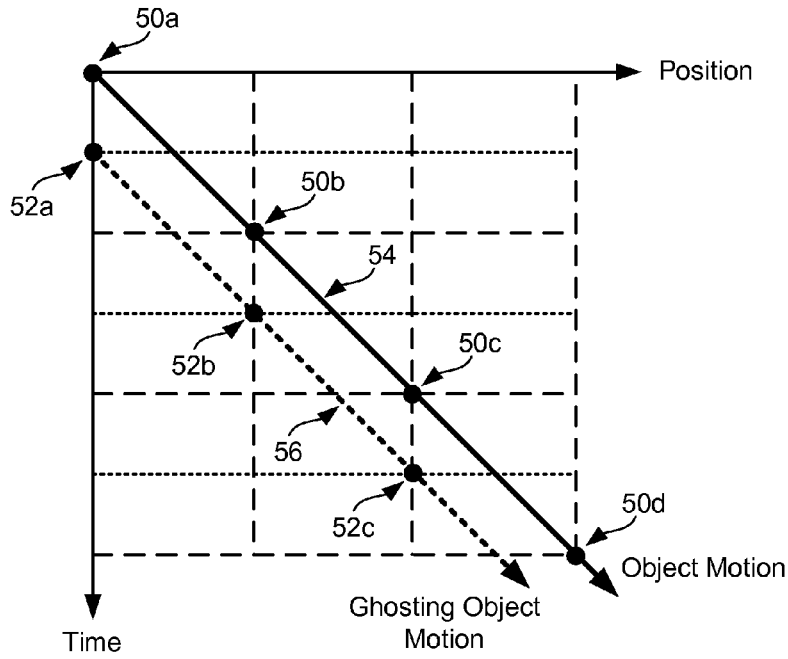
FIG. 5 is a chart illustrating a ghosting effect.

FIG. 5 illustrates the path of an object with constant motion on a display with double flashing. With the first flashing of each frame period 50*a*-50*d*, we can see the object moving along the solid line 54. With the second flashing at half of a frame period later 52*a*-52*c*, the same image is shown again, but shifted in the time axis by half of the frame period. The perceived object motion is along the dashed line 56 (ghosting object).

One way to solve this ghosting problem is to drive the LCD at the same rate as the backlight flashing rate, e.g. 120 Hz, and using motion compensated frame interpolation. However, the costs associated with motion estimation and a high frame rate driver in LCD is generally prohibitive.

Some embodiments of the present invention comprise a motion-detection-based temporal dithering algorithm that can adapt to the video content. Each frame in a video sequence may be divided into multiple blocks. Each block corresponds to a backlight element, such as a CCFL tube or an LED. The backlight (e.g., CCFL tube or LED) may be operated in either "on" or "off" mode. Temporal dithering may be used to have the desired backlight output for each block. In temporal dithering, the desired backlight level is compared to a preset value called the screen function. If the backlight level is greater than the screen function, the backlight is turned on; otherwise, the backlight is off.

In some embodiments, motion detection may be performed to classify each block as a motion block or a still block. The motion blocks may be temporally dithered with a "cluster" screen that is optimized for rendering a motion image. The still blocks may be dithered with a "dispersed" screen that is optimized for reducing flickering. The cluster screen can prevent motion blur, and since these blocks contain motion, flickering is typically not visible in these blocks. The dispersed screen can increase the backlight frequency to above the human visual system's flickering perception threshold.

Figure 6:
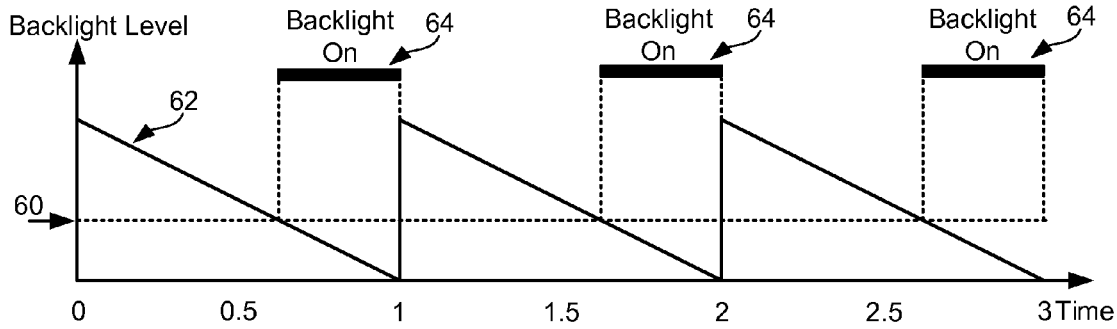
FIG. 6 is a plot showing an exemplary cluster screen function with backlight on times.

FIG. 6 shows an exemplary temporal dithering using a cluster screen. An exemplary screen function for a cluster screen is given by $$S_c(t)=A(1-(t-\text{floor}(t)))$$

where t is the time in frames, and A is the screen amplitude, which determines the flashing duty cycle. Larger A reduces the duty cycle, which leads to lower motion blur.

Figure 7:
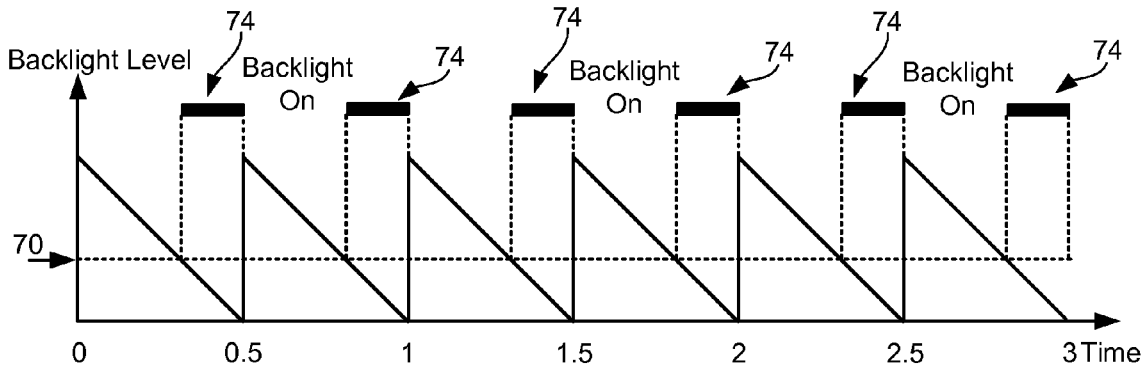
FIG. 7 is a plot showing an exemplary disperse screen function with backlight on times.

FIG. 7 shows an exemplary dispersed screen. An exemplary screen function for the dispersed screen is given by $$S_d=A(1-(2t-\text{floor}(2t))).$$

The desired backlight level 60, 70 (dashed line in the figures) is compared to the screen function 62, 72 (solid line). If the desired backlight level 60, 70 is greater than the screen function 62, 72, the backlight is on as indicated with the thick solid line on top of the FIGS. 64, 74. In this exemplary embodiment, the backlight on a dispersed screen 74 has twice the temporal frequency as the backlight with the cluster screen 64, which can eliminate the perception of flickering. In other embodiments, other functions and mathematical relationships may be used to define cluster and dispersed screen functions. For example, sinusoidal functions, step functions, triangular functions and other functions and relationships may be used in some embodiments. It should be noted, however, in this exemplary embodiment, that the backlight is turned on at the later end of each backlight period. This may occur at the end of the frame period, as in the cluster screen with only one backlight period per frame or at the end of each backlight period of a frame, as in the dispersed screen where a backlight period may end at the midpoint of a frame period as well as the end of the frame period. Configuring the backlight o go on at the end of each backlight period gives the LCD more time to respond to its signal and reach its desired output.

Figure 8:
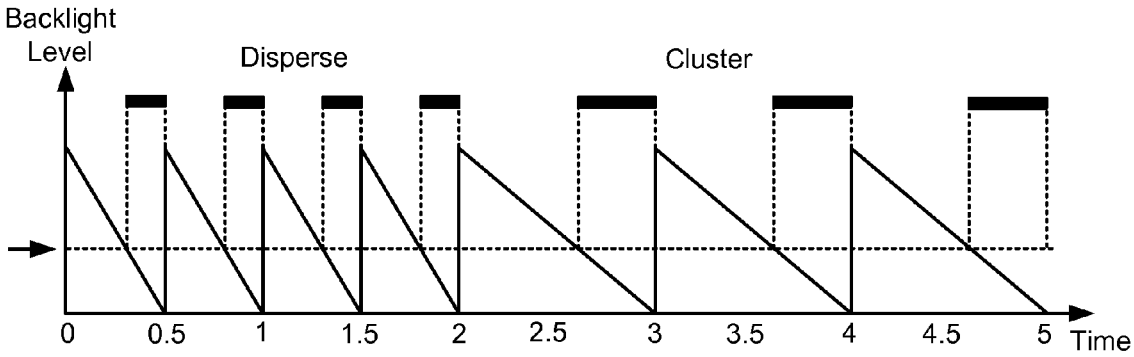
FIG. 8 is a plot showing a transition between disperse and cluster screen functions.

One problem with the two-screen approach is the boundary effect. Switching from one screen (e.g., disperse) to another screen (e.g., cluster) causes a temporal discontinuity as shown in FIG. 8. This discontinuity coupled with motion tracking of the eye causes flickering. Although this flickering is at a lower amplitude, it is also at a lower frequency and is therefore more objectionable to a typical viewer.

Figure 9:
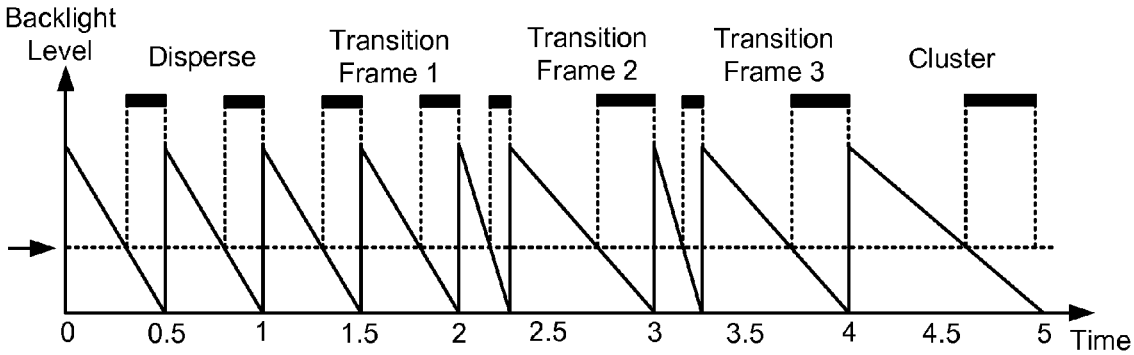
FIG. 9 is a plot showing a transition between disperse and cluster screen functions using transition frames.

To remove this flickering effect, some embodiments of the present invention create a transition region that may last one or more frames to gradually transition from one dither screen to another. FIG. 9 illustrates an exemplary scheme using three transition screens to reduce the flickering effect. The screens in the transition frames are given by:

$$S_t = \begin{cases} A\left(1 - \dfrac{t - \text{floor}(t)}{0.5\left(1 - \dfrac{i}{N}\right)}\right) & 0 <= t - \text{floor}(t) < 0.5\left(1 - \dfrac{i}{N}\right) \\ A\left(1 - \dfrac{t - 0.5\left(1 - \dfrac{i}{N}\right) - \text{floor}\left(t - 0.5\left(1 - \dfrac{i}{N}\right)\right)}{0.5\left(1 + \dfrac{i}{N}\right)}\right) & 0.5\left(1 - \dfrac{i}{N}\right) <= t - \text{floor}(t) < 1 \end{cases}$$

$$i = 0{:}N$$

where N is the total number of transition frames, and i denotes the $i^{th}$ transition frame. The transition from cluster to disperse may be the reverse of the transition from disperse to cluster.

The concept of dithering using disperse and cluster screens can be implemented using an LED driver with programmable "on" timing and "off" timing.

Figure 10:
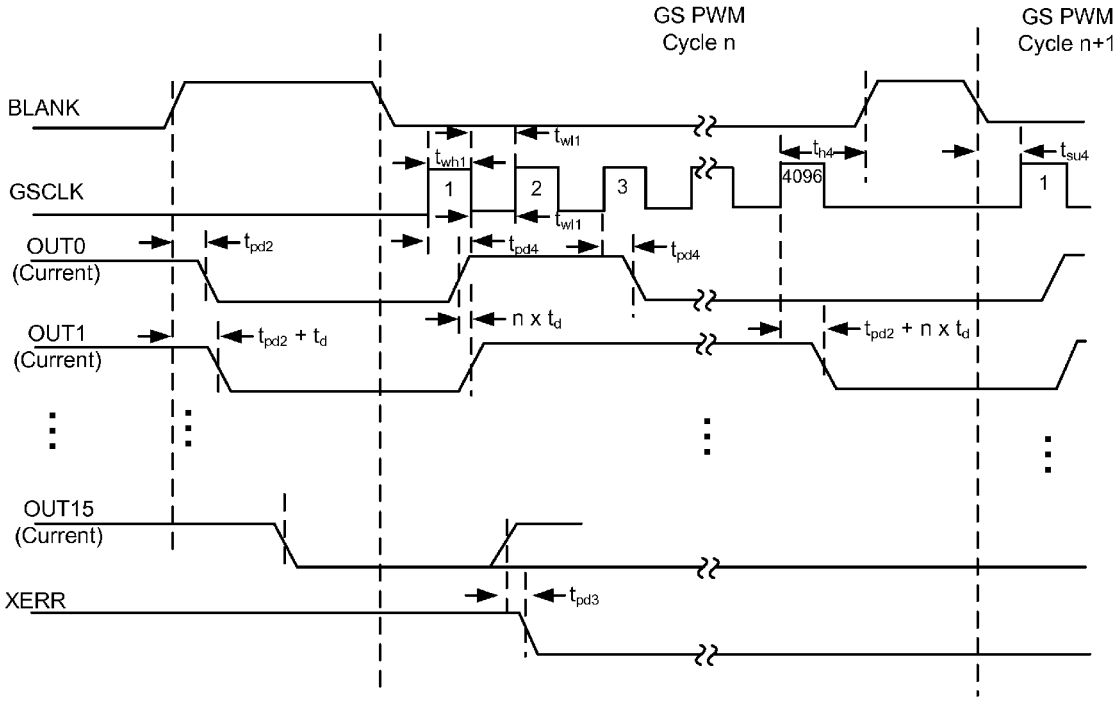
FIG. 10 is a diagram showing a timing chart for a typical processor.

FIG. 10 shows the grayscale PWM timing chart of a typical processor. This processor controls 16 LEDs and all 16 LEDs share the same "on" timing, which is the falling edge of the BLANK signal. Since each LED's "on" timing and "off" timing are adaptive based on image content as well as motion. Some embodiments of the present invention are adapted to be implemented using this driver.

Figure 11:
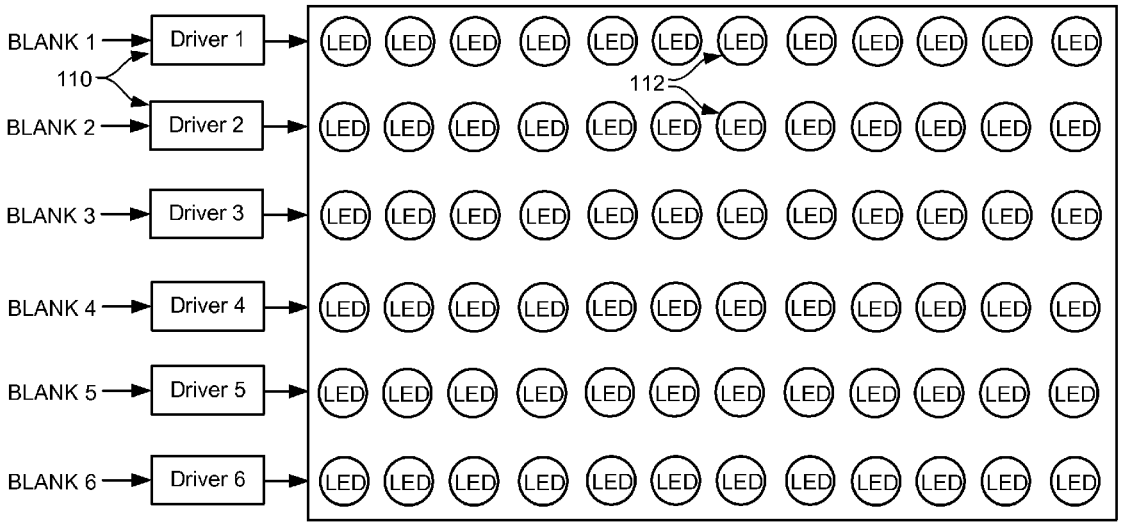
FIG. 11 is a diagram showing an LED backlight array.
Figure 12:
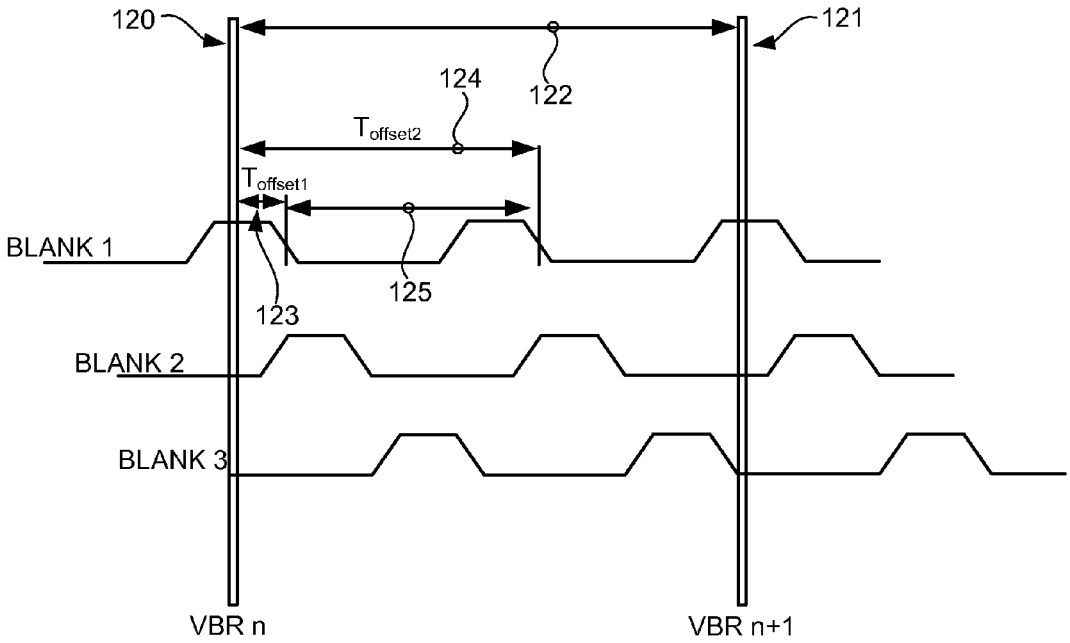
FIG. 12 is a diagram showing offset blank signals.

FIG. 11 shows a typical arrangement of LED drivers 110 and LED backlight elements 112 in a display. Each driver 110 controls LEDs 112 in the same vertical position. The PWM "on" time is controlled by the BLANK signal. To compensate for the time difference between LCD driving from top to bottom, the BLANK signal may be shifted in synchronization with the LCD driving as shown in FIG. 12. In this exemplary embodiment, $VBR_n$ 120 and $VBR_{n+1}$ 121 are two vertical blanking retracing signals, which define an LCD frame time 122. For each LCD frame, there may be two (or more) LED PWM pulses. In some embodiments, the time between the two PWM pulses 125 ($T_{offset2}-T_{offset1}$) is exactly half of the LCD frame time 122 in this exemplary embodiment. $T_{offset1}$ 123 and $T_{offset2}$ 124 are adjusted based on their vertical position to synchronize with the LCD driving. For shorter duty cycles (i.e., duty cycle less than 100%), $T_{offset1}$ 123 and $T_{offset2}$ 124 should be shifted to the right so that PWM on occurs at the flat part of the LCD temporal response curve 20 as shown in FIG. 2.

The use of two PWM pulses in one LCD frame enables motion adaptive backlight flashing. If there is no detected motion, the two PWM pulses may have the same width, but may be offset in time by half of an LCD frame time. If the LCD frame rate is 60 Hz, the perceived image is actually 120 Hz, thus eliminating the perception of flickering. If motion is detected, the first PWM pulse may be reduced or eliminated, while the width of the second PWM pulse in that frame may be increased to maintain the overall brightness. Elimination of the first PWM pulse may significantly reduce the temporal aperture thereby reducing motion blur.

Figure 13A:
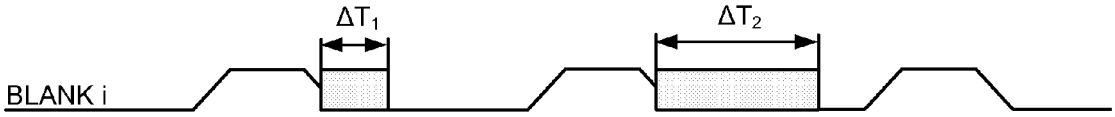
FIG. 13A is a diagram showing pulse widths corresponding to a blank signal, wherein pulse widths are measured forward from the leading edge of the pulse.

FIG. 13A shows the PWM pulses in LED driving in a traditional LED driver. Assume the LED intensity is I {0,1} and duty cycle is λ {0,100%}, the PWM "on" time in terms of fractions of an LCD frame time is given by $$\Delta T = \lambda I$$

$$\Delta T_1 + \Delta T_2 = \Delta T'$$

Figure 13B:
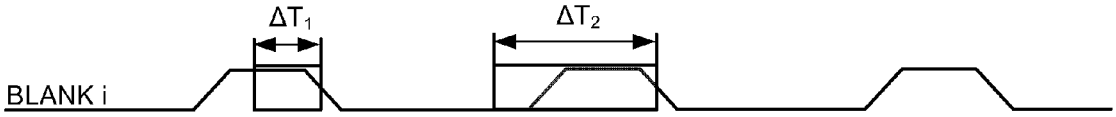
FIG. 13B is a diagram showing pulse widths corresponding to a blank signal, wherein pulse widths are measured backward from the leading edge of the pulse.

An alternative approach in the LED driver is to set the PWM "off" signal at the blank signal, and the PWM "on" to be sometime before the blank signal as shown in FIG. 13B. This enables the backlight to be on when LCD reaches the target value, thus reducing ghosting.

Figure 14:
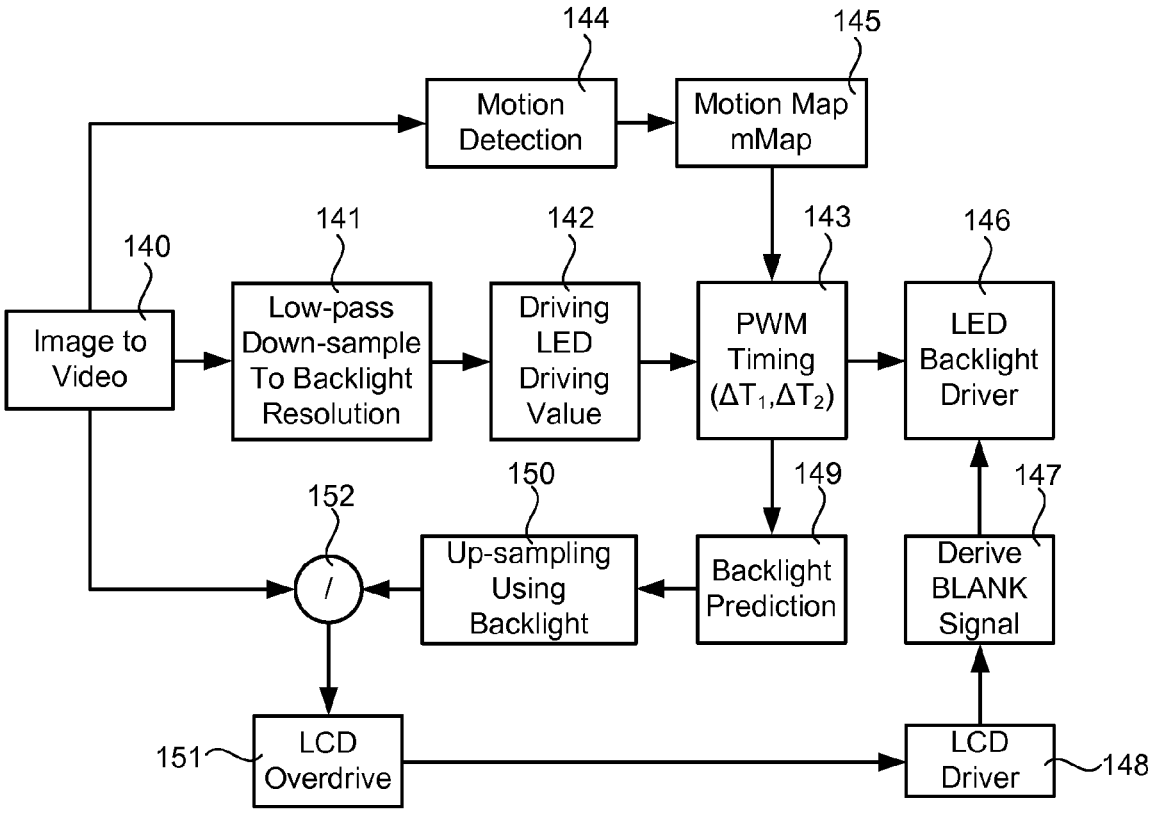
FIG. 14 is a diagram showing an exemplary apparatus comprising PWM timing correlated with a blank signal.

FIG. 14 shows an exemplary flow diagram comprising aspects of the present invention, which convert input image/video to be displayed on a display with an area adaptive backlight comprising a lower resolution LED backlight and higher resolution LCD. In these exemplary embodiments, an input image frame 140 is low-pass filtered and then sub-sampled 141 to the backlight resolution. The backlight resolution may be determined by the number of backlight units, e.g. the number of LEDs in the backlight. Each pixel in the low resolution backlight image corresponds to a block in the input HDR image 140.

For each backlight element or HDR block, motion detection 144 is performed to determine whether it is a motion block or still block. For motion detection purposes, each backlight block may be subdivided into sub-blocks. In some embodiments, each sub-block may consist of 8×8 pixels in the high resolution HDR image 140.

In an exemplary embodiment, the process of motion detection 144, resulting in a motion map 145 and the determination of pulse timing 143, are as follows:

For each frame,

1. Calculate the average of each sub-block in the HDR image for the current frame.
2. If the difference between the average in this frame and the sub-block average of the previous frame is greater than a threshold (e.g., 5% of total range), then the backlight block that contains the sub-block is a motion block. Thus a first motion map is formed.
3. Perform a morphological dilation operation on the first motion map (change the still blocks neighboring a motion block to motion blocks) to form a second motion map.
4. Perform a logical "OR" operation on the second motion map of the current frame with the second motion map of a previous frame to form a third motion map.
5. For each backlight block,
   if it is motion block,
   mMap(i,j)=max(N, mMap (i,j)+1); where N is number of transition frames else (still block)
   mMap (ij)=min(0, mMap (i,j)−1);

6. The PWM pulse "on" widths are given by $$\Delta T_1(i, j) = \left(1 - \frac{mMap(i, j)}{N}\right)\frac{\Delta T}{2}$$

$$\Delta T_2(i, j) = \left(1 + \frac{mMap(i, j)}{N}\right)\frac{\Delta T}{2}$$

if $\Delta T_2 > 0.5$ $$\Delta T_1 = \Delta T - 0.5$$

$$\Delta T_2 = 0.5$$

The sub-sampled and low-pass filtered image 141 may be used to determine LED driving values 142, which may be sent to the LED backlight driver 146 after combination with the pulse timing data 143. Pulse timing data 143 may also be sent to a backlight prediction process 149. The actual backlight image that will be used to illuminate the full resolution input image 140, may be predicted by convolving the backlight signal with the point spread function of the display, which comprises the diffusion layer. This image may then be up-sampled 150 to the full LCD image resolution. The input image 140 may then be divided 152 by the up-sampled backlight image to create a display image that will have the proper image characteristics when displayed with the pulsed backlight determined for the image. This display image data may then be sent to the overdrive circuit 151, which may also access a frame buffer to determine overdrive image values. The overdriven image values may then be sent to the LCD driver 148, where a blank signal may be derived 147 and sent to the backlight driver 146 to synchronize LED flashing with LCD driving. The pulsed backlight may then be used to display the overdriven display image.

The terms and expressions which have been employed in the foregoing specification are used therein as terms of description and not of limitation, and there is no intention in the use of such terms and expressions of excluding equivalence of the features shown and described or portions thereof.

What is claimed is:

1. A method for determining a display backlight modulation process, said method comprising:

a) performing motion detection on at least a portion of a first frame of a video sequence to determine whether substantial motion occurs in said portion of said first frame;

b) performing motion detection on a corresponding portion of a second frame of said sequence to determine whether substantial motion occurs in said corresponding portion of said second frame;

c) using a first pulse-width-modulated (PWM) backlight modulation screen comprising at least one fixed-width pulse at a first width and a first spacing for said first frame;

d) if substantial motion is detected in one of said first frame and said second frame, but not the other of said first frame and said second frame, using a transition backlight modulation screen for displaying said second frame with a display device, wherein said transition backlight modulation screen comprises pulse widths determined by:

$$\Delta T_1(i, j) = \left(1 - \frac{mMap(i, j)}{N}\right)\frac{\Delta T}{2}$$

$$\Delta T_2(i, j) = \left(1 + \frac{mMap(i, j)}{N}\right)\frac{\Delta T}{2}$$

wherein mMap(i,j) is said motion map variable, $\Delta T_1$ is a first pulse width, $\Delta T_2$ is a second pulse width, $\Delta T$ is a total pulse width time, and N is the number of transition frames.

2. A method as described in claim 1 wherein said motion detection comprises determining an average pixel level in said at least a portion of said first frame and said corresponding portion of said second frame.

3. A method as described in claim 1 wherein said motion detection comprises morphological dilation of a motion map based on an average pixel level in said at least a portion of said first frame and said corresponding portion of said second frame.

4. A method as described in claim 1 wherein said motion detection comprises performing a logical OR operation on a motion map for said first frame and a motion map for said second frame.

5. A method as described in claim 1 further comprising the limitation that, if $\Delta T_2 > 0.5$, $\Delta T_1 = \Delta T - 0.5$ and $\Delta T_2 = 0.5$.

6. A method as described in claim 1 wherein said at least a portion of said first frame and said corresponding portion of said second frame correspond to a display backlight element.

7. A method for determining a display backlight modulation process, said method comprising:

a) comparing a first block of a first frame of a video sequence to a corresponding second block of a second frame of said video sequence to determine whether motion occurs in said second block, wherein said comparing is performed with a processor and a memory;

b) incrementing a motion map variable for a pixel in said second block when said comparing results in a determination that motion occurs in said second block;

c) decrementing said motion map variable when said comparing results in a determination that motion does not occur in said second block; and d) creating a backlight modulation screen for said second block, wherein said backlight modulation screen comprises at least one pulse with a pulse width that is dependent on said motion map variable, wherein said at least one pulse has a pulse width determined by:

$$\Delta T_1(i, j) = \left(1 - \frac{mMap(i, j)}{4}\right)\frac{\Delta T}{2}$$

$$\Delta T_2(i, j) = \left(1 + \frac{mMap(i, j)}{4}\right)\frac{\Delta T}{2},$$

wherein mMap(i,j) is said motion map variable, $\Delta T_1$ is a first pulse width, $\Delta T_2$ is a second pulse width and $\Delta T$ is a total pulse width time.

8. A method as described in claim 7 wherein said comparing comprises determining an average value for pixels in said first block and said second block and determining that motion occurs when said average value for said first block differs from said average value for said second block by a threshold amount.

9. A method as described in claim 7 wherein said comparing comprises creating a motion map based on a comparison of pixel values in said first block and said second block and performing morphological dilation on said motion map.

10. A method as described in claim 7 wherein said comparing comprises creating a first motion map for said first frame and second motion map for said second frame and performing a logical OR operation on said first motion map and said second motion map to create a third motion map.

11. A method as described in claim 7 wherein said first block and said second block correspond to a display backlight element.

12. An apparatus for determining a display backlight modulation process, said apparatus comprising:

a) a motion detector for comparing a first block of a first frame of a video sequence to a corresponding second block of a second frame of said video sequence to determine whether motion occurs in said second block;

b) a motion map manager for incrementing a motion map variable for a pixel in said second block when said comparing results in a determination that motion occurs in said second block;

c) said motion map manager also for decrementing said motion map variable when said comparing results in a determination that motion does not occur in said second block; and d) a screen generator for creating a backlight modulation screen for said second block, wherein said backlight modulation screen comprises at least one pulse with a pulse width that is dependent on said motion map variable, wherein said at least one pulse has a pulse width determined by:

$$\Delta T_1(i, j) = \left(1 - \frac{mMap(i, j)}{N}\right)\frac{\Delta T}{2}$$

$$\Delta T_2(i, j) = \left(1 + \frac{mMap(i, j)}{N}\right)\frac{\Delta T}{2},$$

wherein mMap(i,j) is said motion map variable, $\Delta T_1$ is a first pulse width, $\Delta T_2$ is a second pulse width and $\Delta T$ is a total pulse width time.

13. An apparatus as described in claim 12 wherein said comparing comprises creating a first motion map for said first frame and second motion map for said second frame and performing a logical OR operation on said first motion map and said second motion map to create a third motion map.

* * * * *